US011238823B1

(12) United States Patent
Tao

(10) Patent No.: US 11,238,823 B1
(45) Date of Patent: Feb. 1, 2022

(54) GOA CIRCUIT, DISPLAY PANEL AND DISPLAY DEVICE

(71) Applicant: WUHAN CHINA STAR OPTOELECTRONICS TECHNOLOGY CO., LTD., Hubei (CN)

(72) Inventor: Jian Tao, Hubei (CN)

(73) Assignee: WUHAN CHINA STAR OPTOELECTRONICS TECHNOLOGY CO., LTD., Hubei (CN)

( * ) Notice: Subject to any disclaimer, the term of this patent is extended or adjusted under 35 U.S.C. 154(b) by 27 days.

(21) Appl. No.: 16/979,234

(22) PCT Filed: Jul. 30, 2020

(86) PCT No.: PCT/CN2020/105769

§ 371 (c)(1),
(2) Date: Sep. 9, 2020

(51) Int. Cl.
*G09G 3/36* (2006.01)

(52) U.S. Cl.
CPC ..... *G09G 3/3677* (2013.01); *G09G 2310/063* (2013.01); *G09G 2310/08* (2013.01); *G09G 2320/0204* (2013.01)

(58) Field of Classification Search
None
See application file for complete search history.

(56) References Cited

U.S. PATENT DOCUMENTS

| | | | |
|---|---|---|---|
| 2016/0064097 | A1 | 3/2016 | Yang et al. |
| 2016/0343321 | A1 | 11/2016 | Xiao |
| 2017/0102805 | A1 | 4/2017 | Xiao et al. |
| 2017/0243535 | A1 | 8/2017 | Wu et al. |
| 2019/0259338 | A1 | 8/2019 | Yafeng |

FOREIGN PATENT DOCUMENTS

| | | | |
|---|---|---|---|
| CN | 104077992 | A | 10/2014 |
| CN | 104134425 | A | 11/2014 |
| CN | 105206237 | A | 12/2015 |
| CN | 106782366 | A | 5/2017 |
| CN | 108630167 | A | 10/2018 |
| CN | 111326096 | A | 6/2020 |
| WO | 2016070508 | A1 | 5/2016 |

*Primary Examiner* — Aneeta Yodichkas
(74) *Attorney, Agent, or Firm* — Soroker Agmon Nordman

(57) ABSTRACT

A driving circuit, a display panel and a display device are provided. The driving circuit includes cascaded driving units. Each of the driving units comprises a pull-up control circuit, a pull-down circuit, a pull-down maintaining circuit, a bootstrap circuit, a discharging circuit and a reset circuit. Furthermore, the discharging circuit comprises a twelfth TFT and a fourteenth TFT.

20 Claims, 4 Drawing Sheets

GOA CIRCUIT, DISPLAY PANEL AND DISPLAY DEVICE

FIELD OF THE INVENTION

The present invention relates to a display technique, and more particularly, to a GOA circuit, a display panel and a display device.

BACKGROUND

In nowadays, the LCD device is widely used in all kinds of electronic devices. The gate driver on array (GOA) circuit is an important component of the LCD device. GOA represents manufacturing the gate driving circuit on the array substrate by using the conventional TFT LCD array manufacturing process. This is a technique to achieve row-by-row scanning the LCD screen. Because the resolution become higher, which means that the number of rows become greater, it increases the number of errors when the signals are transferred between stages. Furthermore, during the user's operation, an abnormal shut-down may occur. As is known, if a reset operation and a black scan are not performed on the display area after the shut-down, an abnormal display may occur due to the residue charges.

However, the performance of the TFTs in the black scan module of the conventional GOA circuit is not good enough and it does not efficiently pull high the gate. In addition, if the size of the TFTs is slightly inappropriate, it would affect the effect of the black scan after the shut-down and ruins the performance of the display panel.

SUMMARY

Technical Solution

One objective of an embodiment of the present invention is to provide a GOA circuit, a display panel and a display device to solve the above-mentioned issue where a conventional GOA circuit cannot ensure the effect of the black scan.

According to an embodiment of the present invention, a driving circuit is disclosed. The driving circuit comprises a plurality of cascaded driving units. Each of the driving units comprises a pull-up control circuit, a pull-down circuit, a pull-down maintaining circuit, a bootstrap circuit, a discharging circuit and a reset circuit. The pull-up control circuit is electrically connected to the pull-down circuit, the pull-down maintaining circuit, and the bootstrap circuit. The pull-down maintaining circuit is electrically connected to the pull-down circuit. The pull-down maintaining circuit, the bootstrap circuit, the discharging circuit and the reset circuit are all electrically connected to a current-stage gate driving signal output end. The pull-up control circuit is electrically connected to a previous-stage gate driving signal input end. The discharging circuit comprises: a twelfth thin film transistor (TFT), having a gate, a source electrically connected to a first global control signal input end, and a drain electrically connected to the current-stage gate driving signal output end; and a fourteenth TFT, having a gate electrically connected to a constant high voltage signal, a source electrically connected to the first global control signal input end, and a drain electrically connected to the gate of the twelfth TFT; wherein when an input signal of the first global control signal input end corresponds to a high voltage level, a voltage on the gate of the twelfth TFT is larger than a voltage level of the constant high voltage signal input end such that the discharging circuit sufficiently performs a discharging operation.

In another embodiment, the pull-up control circuit comprises: a third TFT, having a gate electrically connected to the previous-stage gate driving signal input end, a source electrically connected to a forward scan DC control signal input end, and a drain electrically connected to the bootstrap circuit; and a first capacitor, having one end electrically connected to a constant low voltage signal input end and another end electrically connected to the bootstrap circuit.

In another embodiment, when the driving unit is a first-stage driving unit, the gate of the third TFT is electrically connected to a scan starting signal input end.

In another embodiment, the bootstrap circuit comprises: a sixth TFT, having a gate electrically connected to the constant high voltage signal input end, a source electrically connected to the pull-up control circuit, and a drain; and an eighth TFT, having a gate electrically connected to the drain of the sixth TFT, a source electrically connected to a current-stage clock signal input end, and a drain electrically connected to the current-stage gate driving signal output end; wherein the bootstrap circuit is configured to control the current-stage gate driving signal output end to output a current-stage gate driving signal when a current-stage clock signal inputted into the current-stage clock signal input end is a constant high voltage signal.

In another embodiment, the pull-down circuit comprises: a first TFT, having a gate electrically connected to the forward scan DC control signal input end, a source electrically connected to a next-stage clock signal input end, and a drain; a second TFT, having a gate electrically connected to a backward scan DC control signal input end, a source electrically connected to a previous-stage clock signal input end, and a drain; a fourth TFT, having a gate electrically connected to a next-stage gate driving signal input end, a source electrically connected to the backward scan DC control signal input end, and a drain; a fifth TFT, having a gate electrically connected to the drain of the first TFT and the drain of the second TFT, a source electrically connected to the constant high voltage signal input end, and a drain electrically connected to the pull-down maintaining circuit; and a ninth TFT, having a gate electrically connected to the drain of the fourth TFT, a source electrically connected to the constant low voltage signal input end, and a drain electrically connected to the pull-down maintaining circuit. The pull-down circuit is configured to pull down a current-stage gate driving signal outputted from the current-stage gate driving signal output end to a constant low voltage level when the input signals inputted into the next-stage clock signal input end and the next-stage gate driving signal input end both corresponds to a high voltage level.

In another embodiment, the driving unit is a last-stage driving unit, the gate of the fourth TFT is electrically connected to a scan driving signal input end.

In another embodiment, the pull-down maintaining circuit comprises: a seventh TFT, having a gate electrically connected to the pull-down circuit, a source electrically connected to the constant low voltage signal input end, and a drain electrically connected to the pull-up control circuit; a tenth TFT, having a gate electrically connected to the first global control signal input end, a source electrically connected to the constant low voltage signal input end, and a drain electrically connected to the gate of the seventh TFT; an eleventh TFT, having a gate electrically connected to the gate of the seventh TFT, a source electrically connected to the constant low voltage signal input end, and a drain electrically connected to the current-stage gate driving signal output end; and a second capacitor. The pull-down maintaining circuit is configured to control the current-stage gate driving signal to be a constant low voltage level when a gate driving signal outputted from the current-stage gate driving signal output end is the constant low voltage level.

In another embodiment, the reset circuit comprises: a thirteen TFT, having a gate electrically connected to a second global control signal input end, a source electrically connected to the constant low voltage signal input end, and a drain electrically connected to the current-stage gate driving signal output end. The reset circuit is configured to pull down a current-stage gate driving signal outputted from the current-stage gate driving signal output end to a constant low voltage level when a second global signal inputted into the second global input signal input end corresponds to a high voltage level.

In another embodiment, the driving circuit is an NMOS-type driving circuit.

According to an embodiment of the present invention, a display panel is disclosed. The display panel comprises the above-mentioned driving circuit.

In another embodiment, the pull-up control circuit comprises: a third TFT, having a gate electrically connected to the previous-stage gate driving signal input end, a source electrically connected to a forward scan DC control signal input end, and a drain electrically connected to the bootstrap circuit; and a first capacitor, having one end electrically connected to a constant low voltage signal input end and another end electrically connected to the bootstrap circuit.

In another embodiment, when the driving unit is a first-stage driving unit, the gate of the third TFT is electrically connected to a scan starting signal input end.

In another embodiment, the bootstrap circuit comprises: a sixth TFT, having a gate electrically connected to the constant high voltage signal input end, a source electrically connected to the pull-up control circuit, and a drain; and an eighth TFT, having a gate electrically connected to the drain of the sixth TFT, a source electrically connected to a current-stage clock signal input end, and a drain electrically connected to the current-stage gate driving signal output end; wherein the bootstrap circuit is configured to control the current-stage gate driving signal output end to output a current-stage gate driving signal when a current-stage clock signal inputted into the current-stage clock signal input end is a constant high voltage signal.

In another embodiment, the pull-down circuit comprises: a first TFT, having a gate electrically connected to the forward scan DC control signal input end, a source electrically connected to a next-stage clock signal input end, and a drain; a second TFT, having a gate electrically connected to a backward scan DC control signal input end, a source electrically connected to a previous-stage clock signal input end, and a drain; a fourth TFT, having a gate electrically connected to a next-stage gate driving signal input end, a source electrically connected to the backward scan DC control signal input end, and a drain; a fifth TFT, having a gate electrically connected to the drain of the first TFT and the drain of the second TFT, a source electrically connected to the constant high voltage signal input end, and a drain electrically connected to the pull-down maintaining circuit; and a ninth TFT, having a gate electrically connected to the drain of the fourth TFT, a source electrically connected to the constant low voltage signal input end, and a drain electrically connected to the pull-down maintaining circuit. The pull-down circuit is configured to pull down a current-stage gate driving signal outputted from the current-stage gate driving signal output end to a constant low voltage level when the input signals inputted into the next-stage clock signal input end and the next-stage gate driving signal input end both corresponds to a high voltage level.

In another embodiment, the driving unit is a last-stage driving unit, the gate of the fourth TFT is electrically connected to a scan driving signal input end.

In another embodiment, the pull-down maintaining circuit comprises: a seventh TFT, having a gate electrically connected to the pull-down circuit, a source electrically connected to the constant low voltage signal input end, and a drain electrically connected to the pull-up control circuit; a tenth TFT, having a gate electrically connected to the first global control signal input end, a source electrically connected to the constant low voltage signal input end, and a drain electrically connected to the gate of the seventh TFT; an eleventh TFT, having a gate electrically connected to the gate of the seventh TFT, a source electrically connected to the constant low voltage signal input end, and a drain electrically connected to the current-stage gate driving signal output end; and a second capacitor. The pull-down maintaining circuit is configured to control the current-stage gate driving signal to be a constant low voltage level when a gate driving signal outputted from the current-stage gate driving signal output end is the constant low voltage level.

In another embodiment, the reset circuit comprises: a thirteen TFT, having a gate electrically connected to a second global control signal input end, a source electrically connected to the constant low voltage signal input end, and a drain electrically connected to the current-stage gate driving signal output end. The reset circuit is configured to pull down a current-stage gate driving signal outputted from the current-stage gate driving signal output end to a constant low voltage level when a second global signal inputted into the second global input signal input end corresponds to a high voltage level.

In another embodiment, the driving circuit is an NMOS-type driving circuit.

According to an embodiment of the present invention, a display device is disclosed. The display device comprises the above-mentioned display panel.

In another embodiment, an input signal inputted into the first global control signal input end corresponds to a low voltage level in a normal display stage of the display device.

Advantageous Effects

The present invention provides a driving circuit, a display panel and a display device. The driving circuit comprises cascaded driving units. Each of the driving units comprises a pull-up control circuit, a pull-down circuit, a pull-down maintaining circuit, a bootstrap circuit, a discharging circuit and a reset circuit. Furthermore, the discharging circuit comprises a twelfth thin film transistor (TFT) and a fourteenth TFT. Because of the fourteenth TFT, it can prevent the bootstrap voltage from reverse feeding the gate to reduce the gate voltage in the black scan state. This allows the twelfth TFT to be sufficiently turned on such that the output voltage is raised and the discharge circuit could be sufficiently discharged. Furthermore, it could also prevent the abnormal display due to the charge residue in the black scan state. Therefore, the effect of black scan could be ensured without limiting the size of the TFTs in the discharging circuit and thus the reliability of the project could be raised.

BRIEF DESCRIPTION OF THE DRAWINGS

These and other features, aspects and advantages of the present disclosure will become understood with reference to the following description, appended claims and accompanying figures.

DETAILED DESCRIPTION OF PREFERRED EMBODIMENTS

To help a person skilled in the art better understand the solutions of the present disclosure, the following clearly and completely describes the technical solutions in the embodiments of the present invention with reference to the accompanying drawings in the embodiments of the present invention. Apparently, the described embodiments are a part rather than all of the embodiments of the present invention. All other embodiments obtained by a person of ordinary skill in the art based on the embodiments of the present invention without creative efforts shall fall within the protection scope of the present disclosure.

In addition, the term "first", "second" are for illustrative purposes only and are not to be construed as indicating or imposing a relative importance or implicitly indicating the number of technical features indicated. Thus, a feature that limited by "first", "second" may expressly or implicitly include at least one of the features. In the description of the present disclosure, the meaning of "plural" is two or more, unless otherwise specifically defined.

All of the terminologies containing one or more technical or scientific terminologies have the same meanings that persons skilled in the art understand ordinarily unless they are not defined otherwise. For example, "arrange," "couple," and "connect," should be understood generally in the embodiments of the present disclosure. For example, "firmly connect," "detachablely connect," and "integrally connect" are all possible. It is also possible that "mechanically connect," "electrically connect," and "mutually communicate" are used. It is also possible that "directly couple," "indirectly couple via a medium," and "two components mutually interact" are used.

Figure 1:
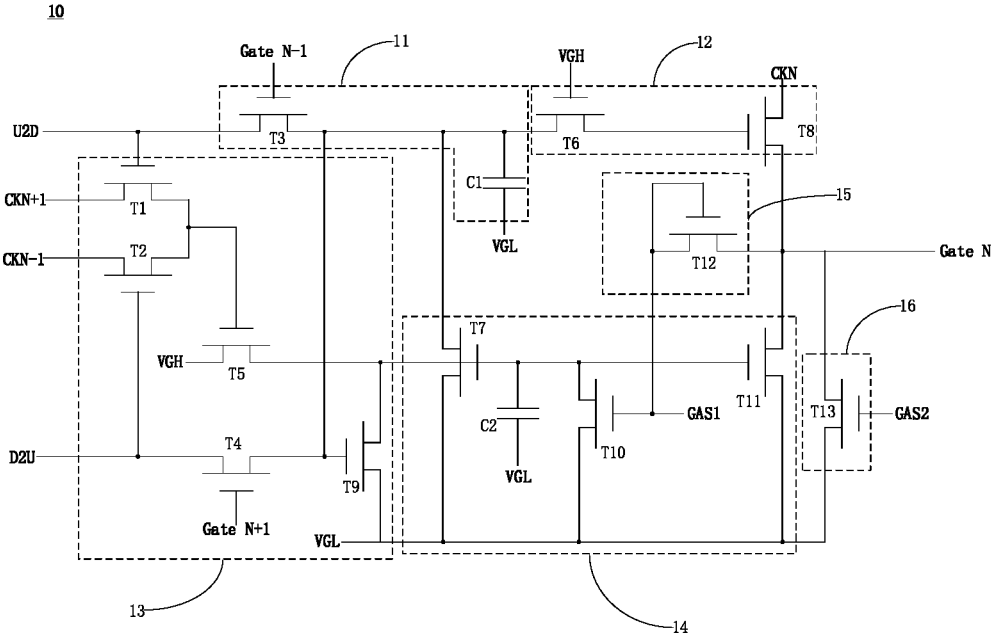
FIG. 1 is a diagram of an $n^{th}$-stage driving unit in a conventional driving circuit.
Figure 2:
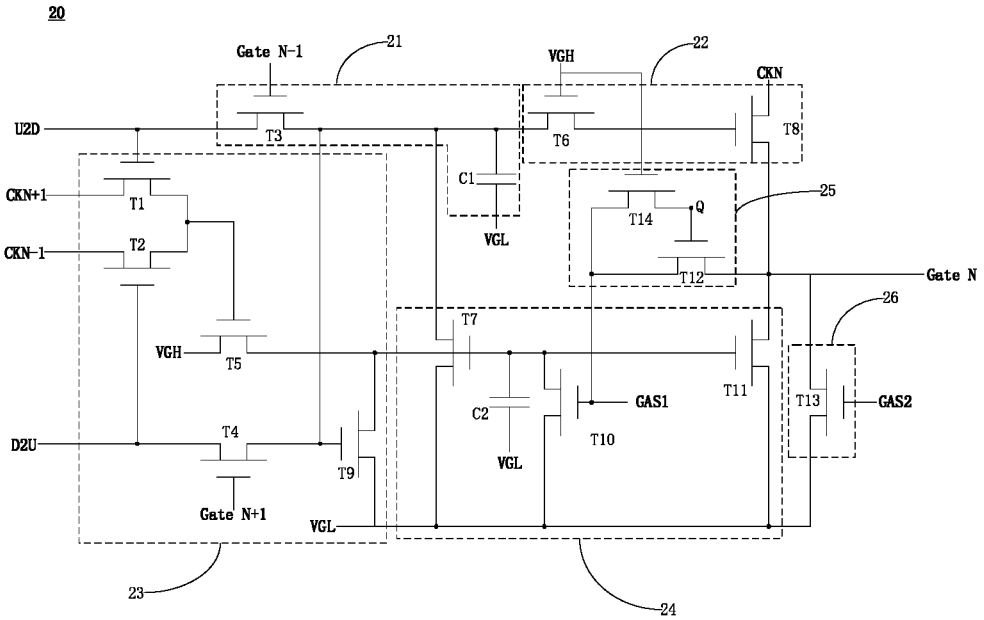
FIG. 2 is a diagram of an $n^{th}$-stage driving unit in a driving circuit according to an embodiment of the present invention.

Please refer to FIG. 1 and FIG. 2. FIG. 1 is a diagram of an $n^{th}$-stage driving circuit in a conventional driving circuit. FIG. 2 is a diagram of an $n^{th}$-stage driving circuit in a driving circuit according to an embodiment of the present invention. The pull-up control circuit 11, the bootstrap circuit 12, the pull-down circuit 13, the pull-down maintaining circuit 14, and the reset circuit 16 in the $n^{th}$-stage driving unit 10 in the conventional driving circuit are respectively identical to the pull-up control circuit 21, the bootstrap circuit 22, the pull-down circuit 23, the pull-down maintaining circuit 24, and the reset circuit 26 in the $n^{th}$-stage driving unit 10 in the driving circuit of an embodiment of the present invention. The only difference is the discharging circuit (the discharging circuit 15 shown in FIG. 1 and the discharging circuit 25 in FIG. 2).

The discharging circuit 15 of the $n^{th}$-stage driving unit 10 in the conventional driving circuit comprises the twelfth TFT T12. The gate of the twelfth TFT T12 is connected to the first global control signal input end GAS1. The source of the twelfth TFT T12 is connected to the gate of the twelfth TFT T12. The drain of the twelfth TFT T12 is connected to the current-stage gate driving signal output end Gate_N. The connection between the gate and the source cannot efficiently pull high the gate voltage. If the output voltage of the current-stage gate driving signal output end needs to be raised, the size of the twelfth TFT T12 needs to be highly accurate. Even if the size of the twelfth TFT T12 is slightly inappropriate, the discharging effect might be ruined and thus the display performance is affected.

Therefore, for the discharging effect, the discharging circuit 25 of the $n^{th}$-stage driving unit 20 comprises the fourteenth TFT T14 and the twelfth TFT T12. In this embodiment, the gate of the fourteenth TFT is connected to the constant high voltage signal input end. The source of the fourteenth TFT T14 is connected to the first global control signal input end GAS1 and the drain of the fourteenth TFT T14 is connected to the gate of the twelfth TFT T12. The source and the drain of the twelfth TFT T12 are connected to the current-stage gate driving signal output end Gate_N.

When the input signal of the first global control signal input end GAS1 corresponds to a high voltage level, the fourteenth TFT T14 could be regarded as a diode, which could prevent the bootstrap voltage at the node Q of the twelfth TFT T12 from reverse feeding the previous stage. When the input signal of the first global control signal input end GAS1 corresponds to a high voltage level, the voltage level at the node Q is about double of the voltage VGH because the currents of the fourteenth TFT T14 and the twelfth TFT both flow to the node Q. This sufficiently turns on the twelfth TFT T12 and thus the output voltage is raised accordingly.

When the input signal of the first global control signal input end GAS1 corresponds to a high voltage level, the twelfth TFT T12 of each driving unit of the driving circuit is turned on such that the output voltage of each gate driving signal output end is raised. This makes all gates on to discharge all the residue charges in the circuit.

Figure 4:
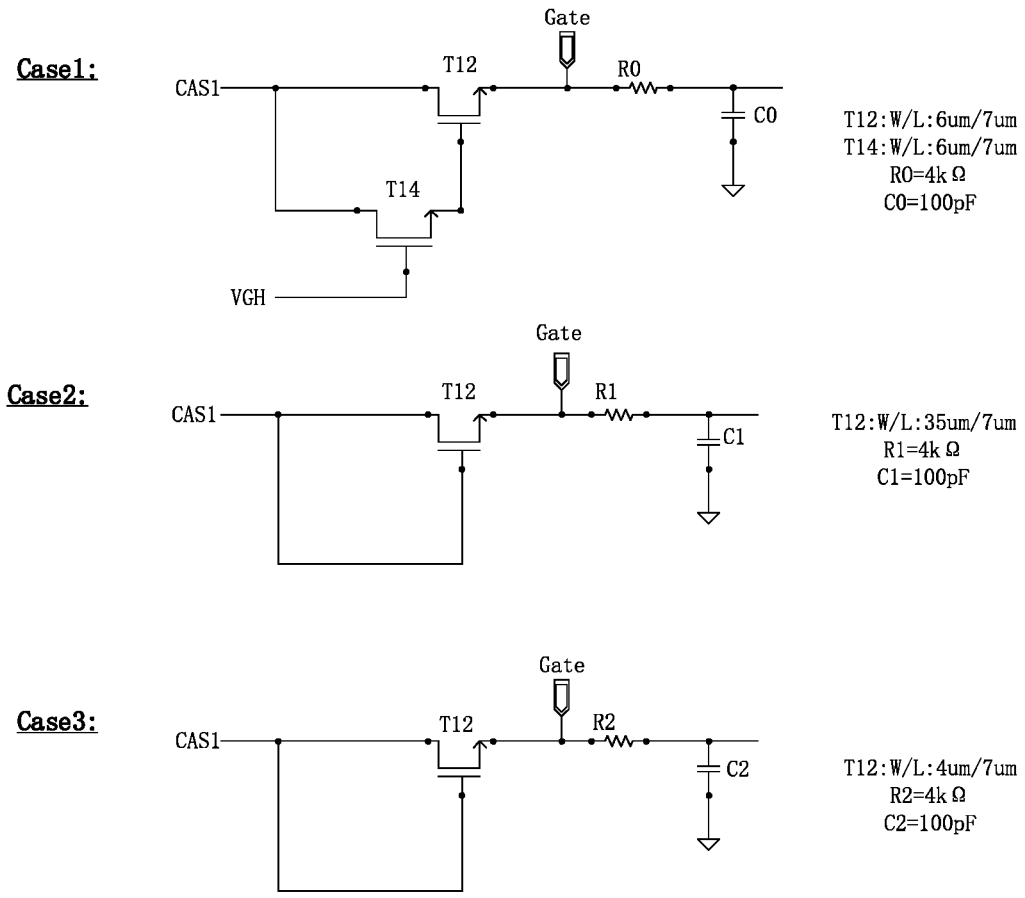
FIG. 4 depicts a simulation of the discharging circuit according to an embodiment of the present invention.
Figure 5:
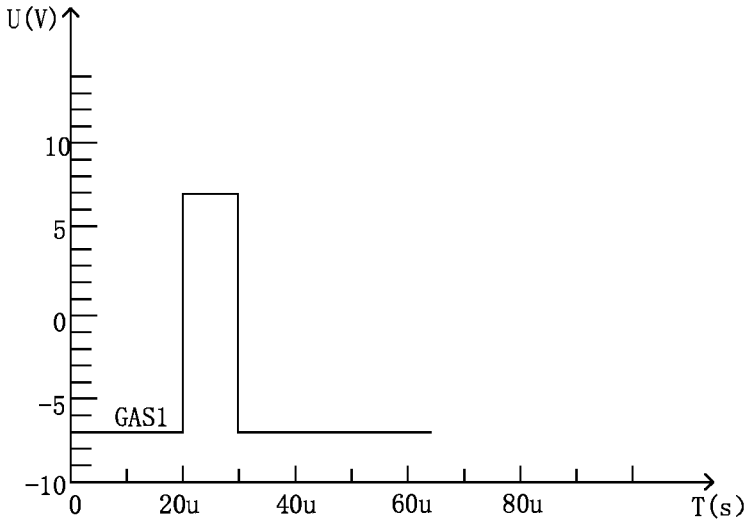
FIG. 5 depicts a simulation of the voltage of the node GAS1 according to an embodiment of the present invention.
Figure 6:
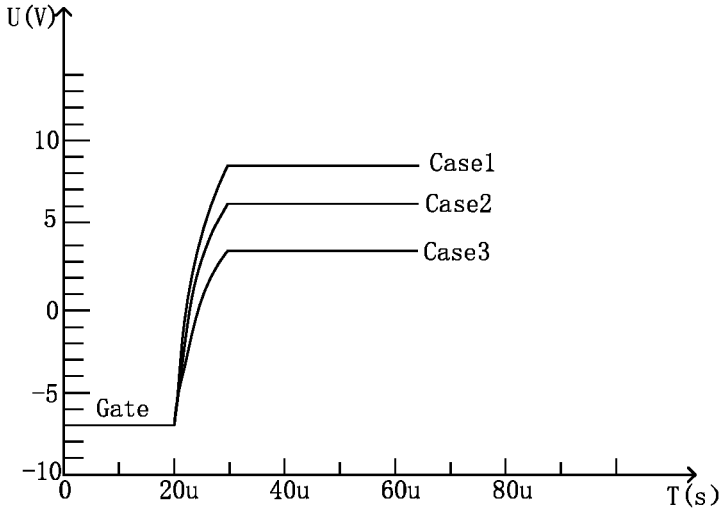
FIG. 6 depicts a simulation of an output voltage according to an embodiment of the present invention.

Please refer to FIG. 4, FIG. 5 and FIG. 6. FIG. 4 depicts a simulation of the discharging circuit according to an embodiment of the present invention. FIG. 5 depicts a simulation of the voltage of the node GAS1 according to an embodiment of the present invention. FIG. 6 depicts a simulation of an output voltage according to an embodiment of the present invention. As shown in FIG. 4, the present invention provides three simulations (Case 1, Case 2, and Case 3). Here, Case 1 is a simulation of the discharging circuit according to an embodiment of the present invention. Case 2 and Case 3 are simulations of the conventional discharging circuit, which only comprises the twelfth TFT T12. The difference between them is: the width to length ratio of the twelfth TFT T12 in Case 2 is 35 um/7 um and the width to length ratio of the twelfth TFT T12 in Case 3 is 4 um/7 um. Please note, in these three simulations, the other components, such as resistance and capacitance, are the same except for the number and the width to length ratio of TFTs. This is to rule out other factors that could influence the output voltage (Gate).

As shown in FIG. 5 and FIG. 6. FIG. 5 and FIG. 6 depict two axes, where the x-axis represents the time T and the y-axis represents the voltage U. Specifically, please refer to FIG. 5, at the time 20 us, the voltage CAS1 changes from low voltage level (−7V) to a high voltage level (7V). In addition, please refer to FIG. 6, at the time 20 us, the output voltages (Gate) of the discharging circuits in three cases are all raised. Here, the output voltage is 8.5V in Case 1, 6.2V in Case 2, and 3.8V in Case 3. These three simulations confirm that the fourteenth TFT T14 could raise the gate voltage of the twelfth TFT T12 and also confirms the requirements for the width-to-length ratio of the twelfth TFT T12 in the conventional discharging circuit.

Please refer to FIG. 2. In this embodiment, the pull-up control circuit 21 comprises the third TFT T3 and the first capacitor C1. The gate of the third TFT T3 is connected to the previous-stage gate signal input end Gate N−1. The source of the third TFT T3 is connected to the forward scan DC control signal input end U2D. The drain of the third TFT T3 is connected to the bootstrap circuit 22. The two ends of the first capacitor C1 are respectively connected to the constant low voltage signal input end VGL and the bootstrap 22.

The pull-up control circuit 21 is mainly used to allow the previous-stage gate driving signal and the forward scan DC control signal to input to the previous-stage gate driving signal input end Gate N−1 and the forward scan DC control signal input end U2D. Here, when the input signal of the forward scan DC control signal input end U2D corresponds to the high voltage level, the driving circuit scans row by row from the top to the bottom.

In some embodiments, when N=1 (which means that the $n^{th}$-stage driving unit is the $1^{st}$ driving circuit), the gate of the third TFT T3 is connected to the scan start signal input end.

In this embodiment, the bootstrap circuit 22 comprises the sixth TFT T6 and the eighth TFT T8. The gate of the sixth TFT T6 is connected to the constant high voltage signal input end VGH. The source of the sixth TFT T6 is connected to the pull-up control circuit 21. The drain of the sixth TFT T6 is connected to the gate of the eighth TFT T8. The source of the eighth TFT T8 is connected to the current-stage clock signal input end CKN. The drain of the eighth TFT T8 is connected to the current-stage gate driving signal output end Gate N. Specifically, the bootstrap circuit is used to control the current-stage gate driving signal output end Gate N to output a current-stage gate driving signal when the current-stage clock signal inputted into the current-stage clock signal input end CKN is a constant high voltage signal.

In this embodiment, the pull-down circuit 23 comprises the first TFT T1, the second TFT T2, the fourth TFT T4, the fifth TFT T5, and the ninth TFT T9. The gate of the first TFT T1 is connected to the forward scan DC control signal input end U2D. The source if the first TFT T1 is connected to the next-stage clock signal input end CKN+1. The drain of the first TFT T1 is connected to the gate of the fifth TFT T5. The gate of the second TFT T2 is connected to the backward scan DC control signal input end D2U. The source of the second TFT T2 is connected to the previous-stage clock signal input end CKN−1. The drain of the second TFT T2 is connected to the gate of the gate of the fifth TFT T5. The gate of the fourth TFT T4 is connected to the next-stage gate driving signal input end Gate N+1. The source of the fourth TFT T4 is connected to the backward scan DC control signal input end D2U. The drain of the fourth TFT T4 is connected to the gate of the ninth TFT T9. The source of the fifth TFT T5 is connected to the constant high voltage signal input end VGH. The drain of the fifth TFT T5 is connected to the pull-down maintaining circuit 24. The source of the ninth TFT T9 is connected to the constant low voltage signal input end VGH. The drain of the ninth TFT T9 is connected to the pull-down maintaining circuit 24. The pull-down circuit 24 is configured to pull down the current-stage gate driving signal outputted from the current-stage gate driving signal output end Gate N to a constant low voltage level when the input signals inputted into the next-stage clock signal input end CKN+1 and the next-stage gate driving signal input end Gate N+1 both corresponds to a high voltage level.

Preferably, in an embodiment, the driving circuit comprises four clock signals, CK1, CK2, CK3 and CK4. It should be noted that when the $n^{th}$-stage CKN is CK1, the previous-stage clock signal CKN−1 is CK4 and the next-stage clock signal CKN+1 is CK2. When the $n^{th}$-stage CKN is CK4, the previous-stage clock signal CKN−1 is CK3 and the next-stage clock signal CKN+1 is CK1.

When the $n^{th}$-stage driving unit 20 is the last-stage driving unit. The gate of the fourth TFT T4 is connected to the scan start signal input end.

In this embodiment, the pull-down maintaining circuit comprises the seventh TFT T7, the tenth TFT T10, the eleventh TFT T11, and the second capacitor C2. The gate of the seventh TFT T7 is connected to the pull-down circuit 23. The source of the seventh TFT is connected to the constant low voltage signal input end VGL. The drain of the seventh TFT is connected to the pull-up control circuit 21. The gate of the tenth TFT T10 is connected to the first global control signal input end GAS1. The source of the tenth TFT T10 is connected to the constant low voltage signal input end VGL. The drain of the tenth TFT T10 is connected to the gate of the seventh TFT T7. The gate of the eleventh TFT T11 is connected to the gate of the seventh TFT T7. The source of the eleventh TFT T11 is connected to the constant low voltage signal input end VGL. The drain of the eleventh TFT T11 is connected to the current-stage gate driving signal output end Gate N. The pull-down maintaining circuit 24 is configured to control the current-stage gate driving signal to be a constant low voltage level when a gate driving signal outputted from the current-stage gate driving signal output end Gate N is the constant low voltage level.

In this embodiment, the reset circuit 26 comprises the thirteen TFT T13. The gate of the thirteen TFT T13 is connected to the second global control signal input end GAS2. The source of the thirteen TFT T13 is connected to the constant low voltage signal input end VGL. The drain of the thirteen TFT T13 is connected to the current-stage gate driving signal output end Gate N. The reset circuit 26 is configured to pull down the current-stage gate driving signal outputted from the current-stage gate driving signal output end Gate N to a constant low voltage level when the second global signal inputted into the second global input signal input end GAS2 corresponds to a high voltage level.

Figure 3:
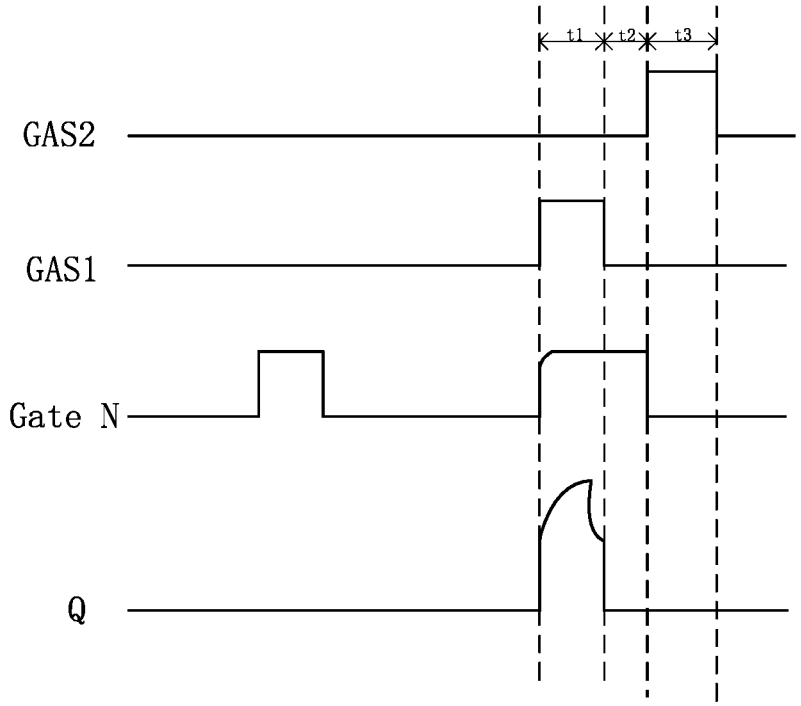
FIG. 3 is a timing diagram of a discharging operation and a reset operation of the driving circuit according to an embodiment of the present invention.

Please refer to FIG. 3. FIG. 3 is a timing diagram of a discharging operation and a reset operation of the driving circuit according to an embodiment of the present invention. Here, t1 represents the discharging operation and t3 represents the reset operation.

During the t1 period, the input signal of the node GAS1 corresponds to a high voltage level. The TFT T12 is turned on. Because the node Q has the bootstrap effect, the voltage level at the node Q is pulled high to around double of VGH. However, because the node Q is not pre-charged to VGH, the waveform has certain distortions but this does not affect the black scan and thus the output waveform at the node Gate N is better.

During the t2 period, the input signal of the node GAS1 corresponds to a low voltage level. The TFT T12 is turned off. Because the input signal inputted into the node GAS2 still corresponds to the low voltage level. Thus, the output voltage at the node Gate N is still high.

During the t3 period, the input signal of the node GAS2 corresponds to a low voltage level. The TFT T13 is turned on. The constant low voltage signal VGL pulls down the output at the node Gate N such that the reset operation is performed.

In this embodiment, the driving circuit is an NMOS-type driving circuit. A driving circuit could be implemented with a CMOS-type driving circuit or an NMOS-type driving circuit. The CMOS-type driving circuit comprises NTFTs (N-type TFT) and PTFTs (P-type TFT) but the NMOS-type driving circuit comprises only the NTFTs. In this embodiment, the discharging circuit 25 could be used in all non-CMOS GOA circuit.

According to an embodiment of the present invention, a display panel is disclosed. The display panel comprises any one of the above-mentioned driving circuits.

According to an embodiment of the present invention, a display device is disclosed. The display device comprises the above-mentioned display panel.

In some embodiments, the input signal inputted into the first global control signal input end GAS1 corresponds to a low voltage level in the normal display stage of the display device.

Furthermore, the input signal inputted into the second global control signal input end GAS2 also corresponds to a low voltage level in the normal display stage of the display device.

The display device often comprises a touch panel. Therefore, the driving circuit might need to implement a signal interruption for the touch panel (for example, for scanning the touch panel). In a normal condition, after the driving circuit performs the signal interruption, the display device needs to be woke up from the black screen. At this time, the driving circuit needs to turn on all the scan lines after a certain period of time and apply a black voltage to discharge all the residue charges in the pixel capacitors such that the display effect could be ensured. This period of time is called All Gate On stage. In the All Gate On stage, the input signal inputted into the first global control signal input end GAS1 corresponds to a high voltage level and the input signal inputted into the second global control signal input end GAS2 corresponds to a low voltage level.

In addition, after the All Gate On stage, the driving circuit should perform the reset operation to prevent the leakage from the gate, which might introduce an abnormal gate voltage such that the driving circuit becomes ineffective. During the reset operation, the input signal inputted into the first global control signal input end GAS1 corresponds to a low voltage level and the input signal inputted into the second global control signal input end GAS2 corresponds to a low voltage level.

The present invention provides a driving circuit, a display panel and a display device. The driving circuit comprises cascaded driving units 20. Each of the driving units 20 comprises a pull-up control circuit 21, a pull-down circuit 23, a pull-down maintaining circuit 24, a bootstrap circuit 22, a discharging circuit 25 and a reset circuit 26. Furthermore, the discharging circuit 25 comprises a twelfth thin film transistor (TFT) T12 and a fourteenth TFT T14. Because of the fourteenth TFT, it can prevent the bootstrap voltage from reverse feeding the gate to reduce the gate voltage in the black scan state. This allows the twelfth TFT to be sufficiently turned on such that the output voltage is raised and the discharge circuit could be sufficiently discharged. Furthermore, it could also prevent the abnormal display due to the charge residue in the black scan state. Therefore, the effect of black scan could be ensured without limiting the size of the TFTs in the discharging circuit and thus the reliability of the project could be raised.

Above are embodiments of the present invention, which does not limit the scope of the present invention. Any modifications, equivalent replacements or improvements within the spirit and principles of the embodiment described above should be covered by the protected scope of the invention.

What is claimed is:

1. A driving circuit, comprising a plurality of cascaded driving units, each of the driving units comprising a pull-up control circuit, a pull-down circuit, a pull-down maintaining circuit, a bootstrap circuit, a discharging circuit and a reset circuit; wherein the pull-up control circuit is electrically connected to the pull-down circuit, the pull-down maintaining circuit, and the bootstrap circuit; the pull-down maintaining circuit is electrically connected to the pull-down circuit; the pull-down maintaining circuit, the bootstrap circuit, the discharging circuit and the reset circuit are all electrically connected to a current-stage gate driving signal output end; and the pull-up control circuit is electrically connected to a previous-stage gate driving signal input end;

wherein the discharging circuit comprises:

a twelfth thin film transistor (TFT), having a gate, a source electrically connected to a first global control signal input end, and a drain electrically connected to the current-stage gate driving signal output end; and a fourteenth TFT, having a gate electrically connected to a constant high voltage signal, a source electrically connected to the first global control signal input end, and a drain electrically connected to the gate of the twelfth TFT;

wherein when an input signal of the first global control signal input end corresponds to a high voltage level, a voltage on the gate of the twelfth TFT is larger than a voltage level of the constant high voltage signal input end such that the discharging circuit sufficiently performs a discharging operation.

2. The driving circuit of claim 1, wherein the pull-up control circuit comprises:

a third TFT, having a gate electrically connected to the previous-stage gate driving signal input end, a source electrically connected to a forward scan DC control signal input end, and a drain electrically connected to the bootstrap circuit; and a first capacitor, having one end electrically connected to a constant low voltage signal input end and another end electrically connected to the bootstrap circuit.

3. The driving circuit of claim 2, wherein when the driving unit is a first-stage driving unit, the gate of the third TFT is electrically connected to a scan starting signal input end.

4. The driving circuit of claim 1, wherein the bootstrap circuit comprises:

a sixth TFT, having a gate electrically connected to the constant high voltage signal input end, a source electrically connected to the pull-up control circuit, and a drain; and an eighth TFT, having a gate electrically connected to the drain of the sixth TFT, a source electrically connected to a current-stage clock signal input end, and a drain electrically connected to the current-stage gate driving signal output end;

wherein the bootstrap circuit is configured to control the current-stage gate driving signal output end to output a current-stage gate driving signal when a current-stage clock signal inputted into the current-stage clock signal input end is a constant high voltage signal.

5. The driving circuit of claim 1, wherein the pull-down circuit comprises:

a first TFT, having a gate electrically connected to the forward scan DC control signal input end, a source electrically connected to a next-stage clock signal input end, and a drain;

a second TFT, having a gate electrically connected to a backward scan DC control signal input end, a source electrically connected to a previous-stage clock signal input end, and a drain;

a fourth TFT, having a gate electrically connected to a next-stage gate driving signal input end, a source electrically connected to the backward scan DC control signal input end, and a drain;

a fifth TFT, having a gate electrically connected to the drain of the first TFT and the drain of the second TFT, a source electrically connected to the constant high voltage signal input end, and a drain electrically connected to the pull-down maintaining circuit; and a ninth TFT, having a gate electrically connected to the drain of the fourth TFT, a source electrically connected to the constant low voltage signal input end, and a drain electrically connected to the pull-down maintaining circuit;

wherein the pull-down circuit is configured to pull down a current-stage gate driving signal outputted from the current-stage gate driving signal output end to a constant low voltage level when the input signals inputted into the next-stage clock signal input end and the next-stage gate driving signal input end both corresponds to a high voltage level.

6. The driving circuit of claim 5, wherein the driving unit is a last-stage driving unit, the gate of the fourth TFT is electrically connected to a scan driving signal input end.

7. The driving signal of claim 1, wherein the pull-down maintaining circuit comprises:

a seventh TFT, having a gate electrically connected to the pull-down circuit, a source electrically connected to the constant low voltage signal input end, and a drain electrically connected to the pull-up control circuit;

a tenth TFT, having a gate electrically connected to the first global control signal input end, a source electrically connected to the constant low voltage signal input end, and a drain electrically connected to the gate of the seventh TFT;

an eleventh TFT, having a gate electrically connected to the gate of the seventh TFT, a source electrically connected to the constant low voltage signal input end, and a drain electrically connected to the current-stage gate driving signal output end; and a second capacitor;

wherein the pull-down maintaining circuit is configured to control the current-stage gate driving signal to be a constant low voltage level when a gate driving signal outputted from the current-stage gate driving signal output end is the constant low voltage level.

8. The driving circuit of claim 1, wherein the reset circuit comprises:

a thirteen TFT, having a gate electrically connected to a second global control signal input end, a source electrically connected to the constant low voltage signal input end, and a drain electrically connected to the current-stage gate driving signal output end;

wherein the reset circuit is configured to pull down a current-stage gate driving signal outputted from the current-stage gate driving signal output end to a constant low voltage level when a second global signal inputted into the second global input signal input end corresponds to a high voltage level.

9. The driving circuit of claim 1, wherein the driving circuit is an NMOS-type driving circuit.

10. A display panel, comprising a driving circuit, the driving circuit comprising a plurality of cascaded driving units, each of the driving units comprising a pull-up control circuit, a pull-down circuit, a pull-down maintaining circuit, a bootstrap circuit, a discharging circuit and a reset circuit; wherein the pull-up control circuit is electrically connected to the pull-down circuit, the pull-down maintaining circuit, and the bootstrap circuit; the pull-down maintaining circuit is electrically connected to the pull-down circuit; the pull-down maintaining circuit, the bootstrap circuit, the discharging circuit and the reset circuit are all electrically connected to a current-stage gate driving signal output end; and the pull-up control circuit is electrically connected to a previous-stage gate driving signal input end;

wherein the discharging circuit comprises:

a twelfth thin film transistor (TFT), having a gate, a source electrically connected to a first global control signal input end, and a drain electrically connected to the current-stage gate driving signal output end; and a fourteenth TFT, having a gate electrically connected to a constant high voltage signal, a source electrically connected to the first global control signal input end, and a drain electrically connected to the gate of the twelfth TFT;

wherein when an input signal of the first global control signal input end corresponds to a high voltage level, a voltage on the gate of the twelfth TFT is larger than a voltage level of the constant high voltage signal input end such that the discharging circuit sufficiently performs a discharging operation.

11. The display panel of claim 10, wherein the pull-up control circuit comprises:

a third TFT, having a gate electrically connected to the previous-stage gate driving signal input end, a source electrically connected to a forward scan DC control signal input end, and a drain electrically connected to the bootstrap circuit; and a first capacitor, having one end electrically connected to a constant low voltage signal input end and another end electrically connected to the bootstrap circuit.

12. The display panel of claim 11, wherein when the driving unit is a first-stage driving unit, the gate of the third TFT is electrically connected to a scan starting signal input end.

13. The display panel of claim 10, wherein the bootstrap circuit comprises:

a sixth TFT, having a gate electrically connected to the constant high voltage signal input end, a source electrically connected to the pull-up control circuit, and a drain; and an eighth TFT, having a gate electrically connected to the drain of the sixth TFT, a source electrically connected to a current-stage clock signal input end, and a drain electrically connected to the current-stage gate driving signal output end;

wherein the bootstrap circuit is configured to control the current-stage gate driving signal output end to output a current-stage gate driving signal when a current-stage clock signal inputted into the current-stage clock signal input end is a constant high voltage signal.

14. The display panel of claim 10, wherein the pull-down circuit comprises:

a first TFT, having a gate electrically connected to the forward scan DC control signal input end, a source electrically connected to a next-stage clock signal input end, and a drain;

a second TFT, having a gate electrically connected to a backward scan DC control signal input end, a source electrically connected to a previous-stage clock signal input end, and a drain;

a fourth TFT, having a gate electrically connected to a next-stage gate driving signal input end, a source electrically connected to the backward scan DC control signal input end, and a drain;

a fifth TFT, having a gate electrically connected to the drain of the first TFT and the drain of the second TFT, a source electrically connected to the constant high voltage signal input end, and a drain electrically connected to the pull-down maintaining circuit; and a ninth TFT, having a gate electrically connected to the drain of the fourth TFT, a source electrically connected to the constant low voltage signal input end, and a drain electrically connected to the pull-down maintaining circuit;

wherein the pull-down circuit is configured to pull down a current-stage gate driving signal outputted from the current-stage gate driving signal output end to a constant low voltage level when the input signals inputted into the next-stage clock signal input end and the next-stage gate driving signal input end both corresponds to a high voltage level.

15. The display panel of claim 14, wherein the driving unit is a last-stage driving unit, the gate of the fourth TFT is electrically connected to a scan driving signal input end.

16. The driving signal of claim 10, wherein the pull-down maintaining circuit comprises:

a seventh TFT, having a gate electrically connected to the pull-down circuit, a source electrically connected to the constant low voltage signal input end, and a drain electrically connected to the pull-up control circuit;

a tenth TFT, having a gate electrically connected to the first global control signal input end, a source electrically connected to the constant low voltage signal input end, and a drain electrically connected to the gate of the seventh TFT;

an eleventh TFT, having a gate electrically connected to the gate of the seventh TFT, a source electrically connected to the constant low voltage signal input end, and a drain electrically connected to the current-stage gate driving signal output end; and a second capacitor;

wherein the pull-down maintaining circuit is configured to control the current-stage gate driving signal to be a constant low voltage level when a gate driving signal outputted from the current-stage gate driving signal output end is the constant low voltage level.

17. The display panel of claim 10, wherein the reset circuit comprises:

a thirteen TFT, having a gate electrically connected to a second global control signal input end, a source electrically connected to the constant low voltage signal input end, and a drain electrically connected to the current-stage gate driving signal output end;

wherein the reset circuit is configured to pull down a current-stage gate driving signal outputted from the current-stage gate driving signal output end to a constant low voltage level when a second global signal inputted into the second global input signal input end corresponds to a high voltage level.

18. The driving circuit of claim 10, wherein the driving circuit is an NMOS-type driving circuit.

19. A display device, comprising a display panel, the display panel comprising a driving circuit, the driving circuit comprising a plurality of cascaded driving units, each of the driving units comprising a pull-up control circuit, a pull-down circuit, a pull-down maintaining circuit, a bootstrap circuit, a discharging circuit and a reset circuit; wherein the pull-up control circuit is electrically connected to the pull-down circuit, the pull-down maintaining circuit, and the bootstrap circuit; the pull-down maintaining circuit is electrically connected to the pull-down circuit; the pull-down maintaining circuit, the bootstrap circuit, the discharging circuit and the reset circuit are all electrically connected to a current-stage gate driving signal output end; and the pull-up control circuit is electrically connected to a previous-stage gate driving signal input end;

wherein the discharging circuit comprises:

a twelfth thin film transistor (TFT), having a gate, a source electrically connected to a first global control signal input end, and a drain electrically connected to the current-stage gate driving signal output end; and a fourteenth TFT, having a gate electrically connected to a constant high voltage signal, a source electrically connected to the first global control signal input end, and a drain electrically connected to the gate of the twelfth TFT;

wherein when an input signal of the first global control signal input end corresponds to a high voltage level, a voltage on the gate of the twelfth TFT is larger than a voltage level of the constant high voltage signal input end such that the discharging circuit sufficiently performs a discharging operation.

20. The display device of claim 19, wherein an input signal inputted into the first global control signal input end corresponds to a low voltage level in a normal display stage of the display device.

* * * * *